US009109408B2

(12) United States Patent
Wang

(10) Patent No.: US 9,109,408 B2
(45) Date of Patent: Aug. 18, 2015

(54) DRILL MEMBERS FOR MINE ROOFS

(75) Inventor: John Wang, Oak Brook, IL (US)

(73) Assignee: Great Industries, Inc., Oak Brook, IL (US)

( * ) Notice: Subject to any disclaimer, the term of this patent is extended or adjusted under 35 U.S.C. 154(b) by 601 days.

(21) Appl. No.: 13/291,811

(22) Filed: Nov. 8, 2011

(65) Prior Publication Data

US 2013/0112481 A1 May 9, 2013

(51) Int. Cl.
*E21B 17/03* (2006.01)
*E21B 17/04* (2006.01)

(52) U.S. Cl.
CPC ..... *E21B 17/03* (2013.01); *E21B 17/04* (2013.01)

(58) Field of Classification Search
CPC ..... E21B 17/04; E21B 17/046; E21B 17/03; E21D 20/00; E21D 20/003
USPC ..... 175/57, 320, 417, 118; 166/242.1; 403/383, 301, 292, 298, 300; 295/328
See application file for complete search history.

(56) References Cited

U.S. PATENT DOCUMENTS

| | | | | |
|---|---|---|---|---|
| 2,733,943 | A | 2/1956 | Nater | |
| 3,178,210 | A | 4/1965 | Dickinson | |
| 3,187,825 | A | 6/1965 | Bower, Jr. | |
| 3,360,285 | A * | 12/1967 | Huckshold | 403/292 |
| 3,554,306 | A | 1/1971 | Wilburn | |
| 4,009,760 | A | 3/1977 | Hansen et al. | |
| 4,019,590 | A * | 4/1977 | Hansen et al. | 175/57 |
| 4,099,585 | A | 7/1978 | Emmerich | |
| 4,206,821 | A * | 6/1980 | Emmerich | 175/321 |
| 4,226,290 | A | 10/1980 | McSweeney | |
| 4,558,976 | A | 12/1985 | Begluitti | |
| 4,702,328 | A | 10/1987 | McSweeney et al. | |
| 4,749,051 | A | 6/1988 | Larsson | |
| 4,773,490 | A | 9/1988 | McSweeney et al. | |
| 6,189,632 | B1 * | 2/2001 | Warden | 175/320 |
| 6,598,688 | B2 * | 7/2003 | Wang | 175/320 |
| 2001/0045303 | A1 * | 11/2001 | Rein et al. | 175/320 |
| 2003/0010539 | A1 | 1/2003 | Wang | |

* cited by examiner

*Primary Examiner* — Jennifer H Gay
*Assistant Examiner* — George Gray
(74) *Attorney, Agent, or Firm* — Erickson Law Group, PC

(57) ABSTRACT

A drilling system for drilling vertical holes in a mine roof includes a chuck configured to be driven in rotation by a motorized drill head. The chuck is cylindrical has a bore having a first polygonal inside perimeter. A drill member has an elongated hollow body with a cross section defining a circular outside perimeter over most of its length and a constant, second polygonal inside perimeter along substantially the entire length of the drill member. The drill member has at least one end region having a first polygonal outside perimeter that is sized to fit into the first polygonal inside perimeter to rotationally engage the drill member with the chuck. Drill bits having a bit fixture having a cross section with a second polygonal outside perimeter are sized and configured to fit snugly inside the second polygonal inside perimeter to be mounted to the drill member opposite the chuck.

22 Claims, 6 Drawing Sheets

FIG 4A
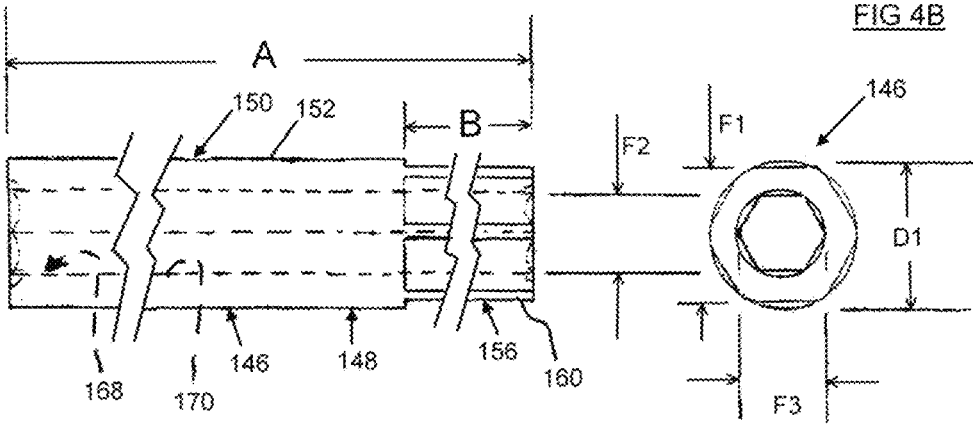
FIG 4B
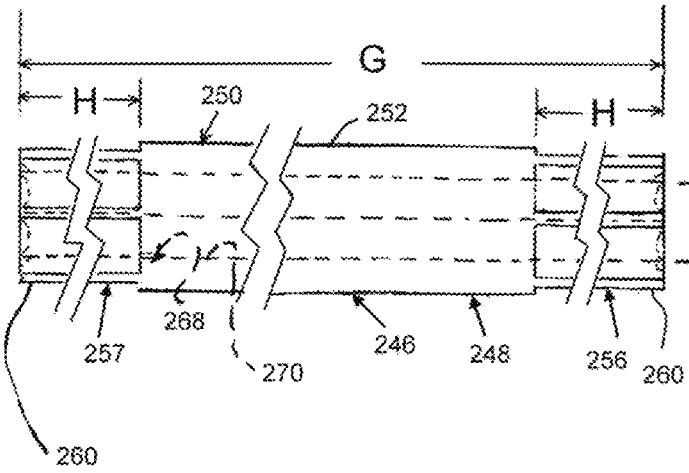
FIG 5A
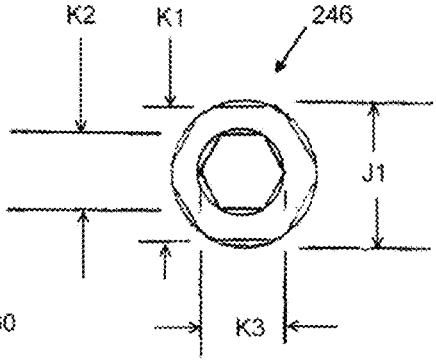
FIG 5B

DRILL MEMBERS FOR MINE ROOFS

TECHNICAL FIELD OF THE INVENTION

The invention relates to drill steel members for a roof drilling system used in mines.

BACKGROUND OF THE INVENTION

In the mining industry, it is known to support the roof of a mine by drilling vertical holes in the overhead rock strata, and then installing roof bolts into the newly drilled holes. The roof bolts are generally installed into the drilled holes with an adhesive to further secure the bolts within the drilled holes. The bolts secure a metal plate that is positioned to support the rock strata to prevent collapse of the mine roof.

To drill holes in the rock strata, a roof drilling machine is utilized. The drilling machines include a drill driving device and drill steel members. A carbide bit is attached to one end of the final drill steel member, to drill the holes in the mine roof. These drill steel members are generally coupled on the other end to the drill driving device by a chuck located on the drilling machine. This driving device rotates the drill steel member, and thus the drill bit, to remove material and debris from the drilled hole. Many drilling machines incorporate a vacuum suction collection system wherein the drill steel member is a hollow steel tube having a central passage, and the drill bit includes a passageway open to the central passage. The vacuum system collects the debris as it is passed through the bit passageway and the central passage during drilling of the rock strata.

In elevated height mines, the drill steel members are provided with a sufficient length for drilling the desired seam, without the need to replace or extend the drill steel member. In low height mines the hole is initially drilled with a shorter drill steel member, often known as a starter, and then the starter is replaced with additional sections of drill steel, such as drivers, extensions and finishers, to drill the remaining depth of the hole. The additional sections are joined together by component parts that include, for example, a drill bit seat, male and female connectors, and a drive end component. The components are attached or configured to connect to the ends of the drill steel members or sections.

According to one system, a drill steel section is cut to the desired drilling length for a particular member and then the ends of the section are beveled and then component parts are welded onto the corresponding ends of the drill steel section.

Many drawbacks for this manufacturing method exist. Welding components and drill sections can induce stress fractures and misalignments.

Other methods have been developed. U.S. Pat. No. 3,554,306 discloses a vacuum drill rod system utilizing tubular members. The tubular members have hexagonal inner and outer cross sectional perimeters which interact with comparable outer and inner cross sectional perimeters of cooperating elements when the rod system is connected to achieve concurrent rotation of the elements of the system. However, this system suffers the drawback that the drill steel rods have hexagonal cross sections that are rotated within the drilled hole. Such rods have been known to cause excessive sound levels within the mine due to the rattling or impact of the hexagonal surface of the drill steel against the round drilled hole.

U.S. Pat. No. 6,189,632 discloses a drilling system utilizing round, hollow drill steel members interconnectable by short components. The short components include a male component machined onto an end of the drill steel member and a corresponding female coupling. The male component comprises an extension with a cross-section defining an external hexagonal perimeter, and the corresponding female coupling element has a cross-section defining an internal hexagonal perimeter, the female component press fit onto the male component. One drawback of this described system is that the drill steel member must be precisely machined to length and must have the aforementioned machined end.

U.S. Pat. No. 6,598,688 discloses a drilling system incorporating a drill member having a central through bore and opposite open ends. The drill member has a cross section that defines a circular outside perimeter and a polygonal inside perimeter. The polygonal inside perimeter allows for convenient coupling of the drill member to drill bits at one end and to a motorized drill driving device at an opposite end. The polygonal inside perimeter allows for coupling of the drill members to other drill members using couplings. In order to couple the drill member to a motorized drill driving device, a base assembly is used. The base assembly includes a stub member and a base member. The base member includes a bottom fixture having a cross section defining a polygonal outside perimeter for being received into a correspondingly shaped socket or chuck of the motorized drill driving device. The base member includes a socket having a polygonal inside perimeter. The base member also includes a collar for receiving axial force from the drill driving device. The stub member includes a bottom fixture having a cross section defining a polygonal outside perimeter that is received into the socket formed in the base member. The stub member further includes a flange that is supported on an internal shoulder within the socket of the base member. In this way, the axial force exerted on the base member by the drill driving device is transferred to the flange of the stub member. The stub member further includes a stub shaft extending upwardly from the flange and having a cross section defining an outside polygonal perimeter, sized and shaped to snugly fit within the open end of the drill member. The socket of the base member is sized such that the drill member fits over the stub shaft and is partially recessed into the socket to press against a top side of the flange of the stub member. In this way, the axial thrust from the base member to the flange is transferred to the end face of the drill member.

The present inventor has recognized the desirability of providing a drilling system for drilling holes for mine roof bolts which does not require undue machining of the drill steel, which does not require the drill steel to be cut to predetermined lengths and which does not produce excessive noise. The present inventor has recognized the desirability of providing a drilling system that does not require special adaptors or parts to couple the drill members or "drill steel" to the chuck of the drill driving device.

SUMMARY OF THE INVENTION

The invention provides an improved drill member, or "drill steel," for use in a drilling system for installing roof bolts in a mine. The invention provides an improved drilling system incorporating the drill member. The drill member comprises an elongated tube having a central through bore and opposite open ends. The tube has a cross section that defines a circular outside perimeter along most of its length and a polygonal inside perimeter throughout its length. At least one end portion of the drill member tube has a polygonal outside perimeter. The end portion can be inserted into a corresponding socket of the drill chuck having a polygonal inside perimeter. The need for a stub member and base member as described in U.S. Pat. No. 6,598,688 is obviated. The polygonal inside perimeter of the drill member tube allows for convenient coupling of the drill member to drill bits at one end and to a motorized drill driving device at an opposite end. The polygonal inside perimeter allows for coupling of the drill members to other drill members using couplings.

The drill members can be cut to any length and the cut open end can accommodate components or interposed couplings without the need for machining a specialized coupling element or configuration onto the member. Additionally, the round outside perimeter allows the drill steel to be more quietly rotated within the drilled hole.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 4A is a side view of a first embodiment drill member according to the invention;

FIG. 4B is a right side end view of the first embodiment drill member shown in FIG. 4A;

FIG. 5A is a side view of a second embodiment drill member according to the invention;

FIG. 5B is a right side end view of the second embodiment drill member shown in FIG. 5A;

DETAILED DESCRIPTION OF THE PREFERRED EMBODIMENTS

Figure 1:
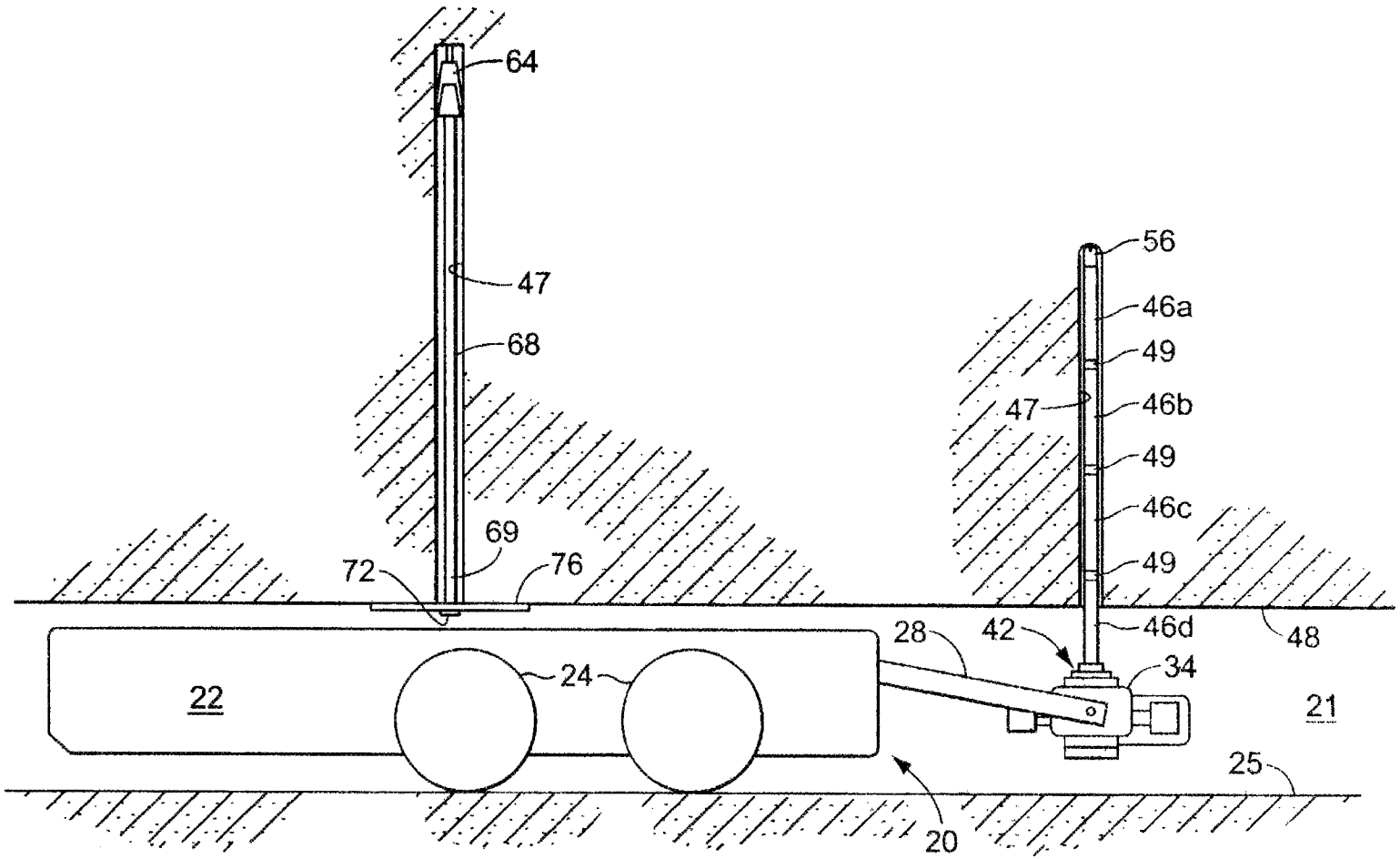
FIG. 1 PRIOR ART
FIG. 1 is a diagrammatic view of a prior art drill system, in use in a mine.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a prior art roof drilling machine 20 as described in U.S. Pat. No. 6,598,688. The machine 20 is designed to operate within low seams 21, such as seams of coal. The drilling machine includes a chassis 22 that is supported on wheels 24 from the mine floor 25. Articulated boom components 28 support a drill head 34 that is a motorized drill driving device.

A base assembly 42 is fit onto, and into, the drill head 34. The base assembly 42 is used to couple a lowest drill member 46*d* to the drill head 34. A drill bit 56 is fixed to an end of the highest drill member 46*a* via a bit seat 59. Drill members 46*a*, 46*b*, 46*c* extend from the lowest drill member 46*d* into the drilled hole 47 into the roof 48.

The hole 47 is initially started by the drill member 46*a* extending from the base 42, and the drill members 46*b*, 46*c*, 46*d* are progressively added, as needed, as the bit 56 progresses into the rock. The drill members 46*a*, 46*b*, 46*c*, 46*d* are connected by interposed connectors or couplings 49, shown in detail in FIGS. 5E and 5F.

Once the hole 47 is drilled, an anchor 64 mounted on a shank 68, is inserted into the hole 47 and a threaded end 69 of the shank receives a nut 72. The nut 72 is tightened to secure a roof plate 76 against the roof 48.

Figure 2A:
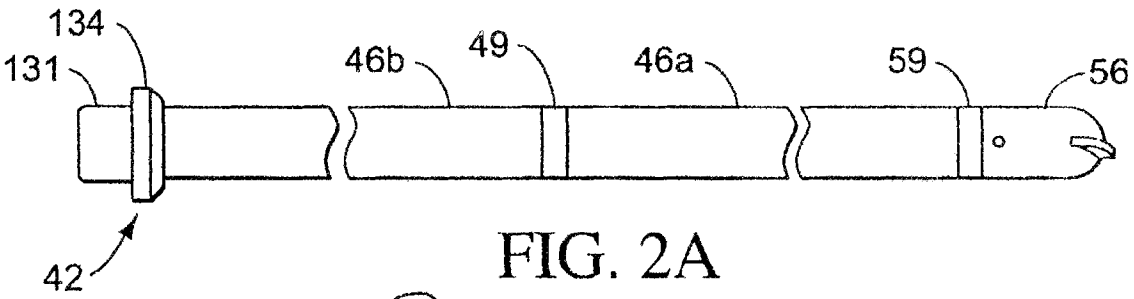
FIG. 2A PRIOR ART
FIG. 2A is an enlarged plan view of the prior art drill components of the drill system of FIG. 1.
Figure 2B:
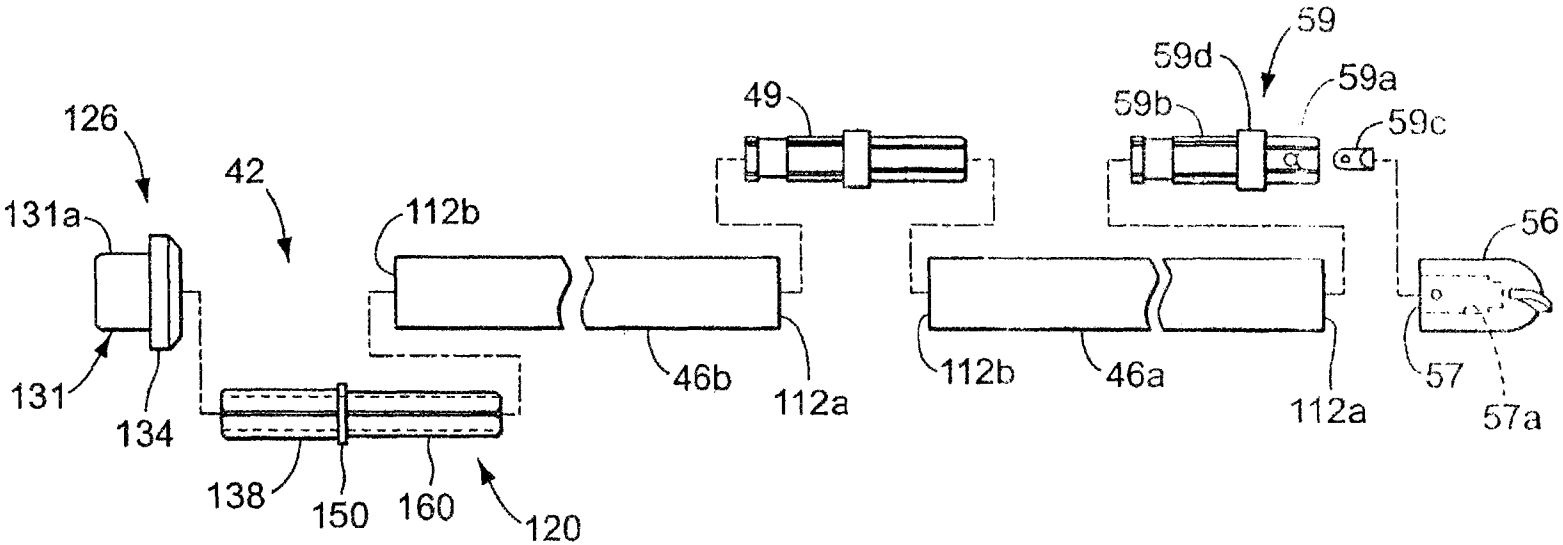
FIG. 2B PRIOR ART
FIG. 2B is an exploded view of the prior art drill components of FIG. 2A.

FIGS. 2A-2B illustrate, as an example, the drill members 46*a*, 46*b*, coupled together and coupled to the base 42, and the bit 56 via a bit seat 59. The drill members 46*a*, 46*b* (and also 46*c*, 46*d*, not in use yet in the configuration shown in FIGS. 2A-2B) each comprise an elongated tube having a round outside perimeter 112*c* and a hexagonal inside perimeter 112*d* defining a central through bore 112 and opposite open ends 112*a*, 112*b* (shown in FIGS. 3A, 3B).

The bit seat 59 includes a bit shank 59*a* and a base shank 59*b* each having polygonal, preferably hexagonal, outside perimeters. The drill bit 56 includes a socket 57 having a polygonal, preferably hexagonal, inside perimeter 57*a*. The bit shank 59*a* and a button clip 59*c* fit within the socket 57 and are used together to tightly engage the bit seat 59 to the bit 56 as explained in U.S. Pat. No. 6,189,632, herein incorporated by reference. The outside perimeter 59*b* of the bit seat shank 59*b* is shaped to snugly fit within the open end 112*a* of the drill member 46*a*. The seat 59 also includes a rounded flange 59*d* that matches the outside diameter of the drill member 46*a*.

Figure 3A:
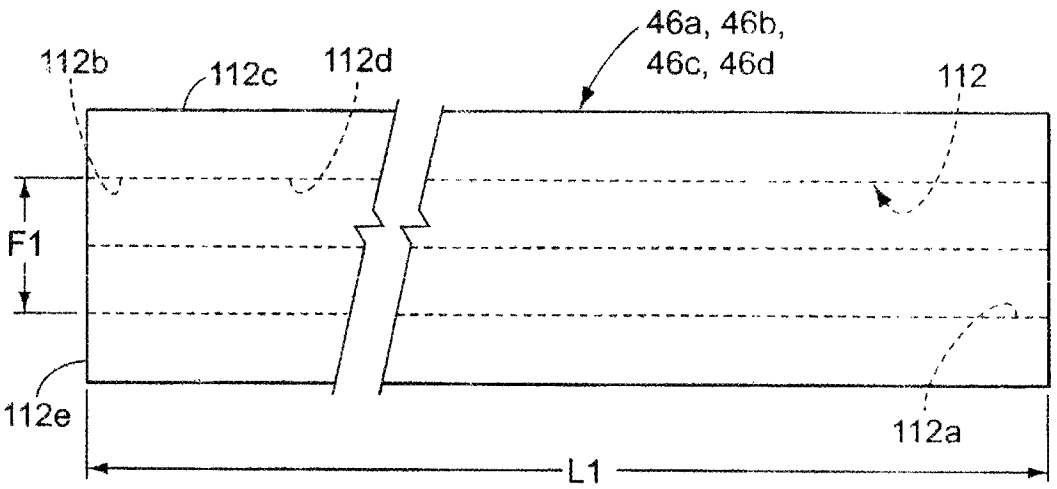
FIG. 3A PRIOR ART
FIG. 3A is an enlarged plan view of the prior art drill member of the drill components shown in FIGS. 2A-2B.
Figure 3B:
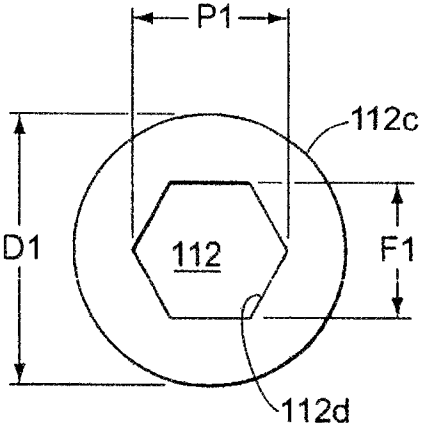
FIG. 3B PRIOR ART
FIG. 3B is a side view of the prior art drill member of FIG. 3A.

FIGS. 3A, 3B illustrate that the members 46*a*, 46*b*, 46*c*, 46*d* each has a cross section that defines the circular outside perimeter 112*c*, and the polygonal inside perimeter 112*d*, defining the through-bore 112.

Returning to FIGS. 2A-2B, the base assembly 42 includes a stub member 120, and a base member 126. The base member 126 includes a bottom fixture 131 having a cross section defining a polygonal outside perimeter 131*a*. The polygonal outside perimeter 131*a* is provided by a square lug portion 170 shown in FIGS. 6A and 60 and described below. The outside perimeter 131*a* is sized to be received into a correspondingly shaped socket (not shown) of the motorized drill driving device 34 to couple the fixture 131 and the drill driving device 34 for mutual rotation. The base member 126 includes a collar 134 for receiving axial (upward) force from the drill driving device 34.

FIGS. 4A-5B illustrate drill members 146, 246 according to the present invention.

A first embodiment drill member of FIGS. 4A-4B includes a tube 148 having a cylinder portion 150 having a circular perimeter 152 throughout most of its length. The tube has an overall length "A." The length "A" can be any practical length but preferably is 24 inches, 36 inches or 48 inches. The perm ter has a preferred diameter D1 of about 0.95 inches or 1.25 inches.

The tube 148 also includes an end portion 156 having a polygonal outside perimeter 160. Preferably the polygonal outside perimeter 160 is hexagonal and has a flat-to-flat dimension F1 of about 0.87 inches or 1.12 inches. Preferably, the end portion has a length B of less than one foot and preferably about 6 inches and is machined into the circular perimeter that otherwise defines the cylindrical portion 150. The tube 148 has an inside through-opening 168 having a polygonal inside perimeter 170. Preferably, the polygonal inside perimeter 170 is hexagonal and has a flat-to-flat dimension F2 of about 0.63 inches or 0.82 inches. Preferably, the polygonal inside perimeter 170 has a point to point dimension F3 of about 0.71 inches or 0.92 inches.

A second embodiment drill member of FIGS. 5A-5B includes a tube 248 having a cylinder portion 250 having a circular perimeter 252 throughout most of its length. The tube has an overall length "G." The length "G" can be any practical length but preferably is 144 inches. The perimeter has a preferred diameter J1 of about 0.95 inches or 1.2 inches. The tube 248 also includes end portions 256, 257 each having a polygonal outside perimeter 260. Preferably the polygonal outside perimeter 260 is hexagonal and has a flat-to-flat dimension K1 of about 0.87 inches or 1.12 inches.

Preferably, the end portion has a length H of less than one foot and preferably about 6 inches and is machined into the circular perimeter that otherwise defines the cylindrical portion 250. The tube 248 has an inside through-opening 268 having a polygonal inside perimeter 270. Preferably, the polygonal inside perimeter 270 is hexagonal and has a flat-to-flat dimension K2 of about 0.63 inches or 0.82 inches. Preferably, the polygonal inside perimeter 270 has a point to point dimension K3 of about 0.70 inches or 0.92 inches. The drill member 246 is especially suitable as drill member stock that can be cut to desired lengths in the mine. Each part of a cut drill member 246 would thus include an end portion 256, 257.

The drill members 146, 246 are preferably composed of 4130 30CrMo.

Figure 6:
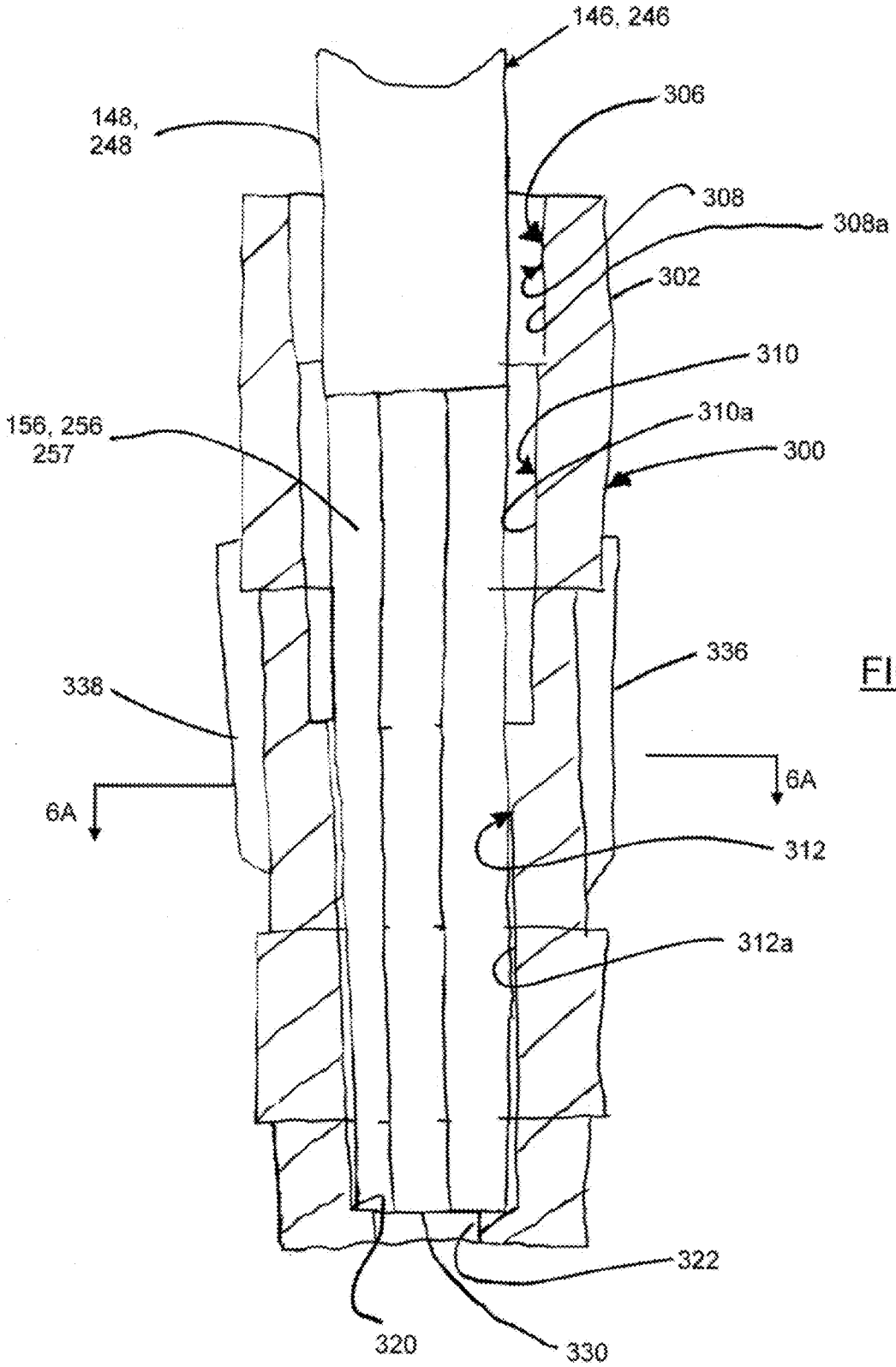
FIG. 6 is a sectional view of a drill member of FIG. 4A or 5A in a chuck of a drilling head.
Figure 6A:
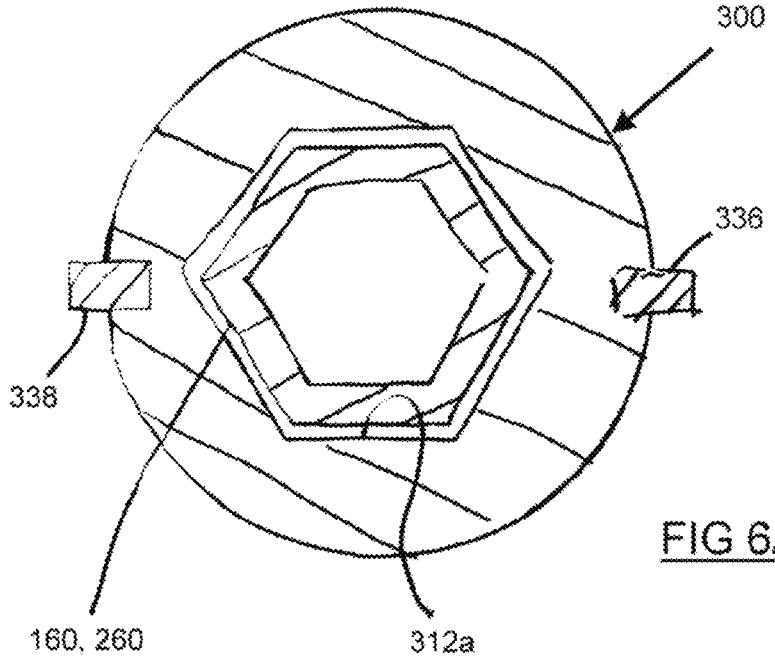

FIG. 6 illustrates how either drill member 146, 246 is coupled directly to a chuck 300 of a drilling head 34. The chuck 300 includes a generally cylindrical body 302 of steel or iron and has a countersunk axial bore 306. The bore 306 includes three regions of differently sized and shaped sockets that are adaptable to receive different is types of drilling elements. A top region 308 has a large square cross-section 308*a*. A next region 310 has a large hexagonal cross-section 310*a*. A lower region 312 has a smaller hexagonal cross-section 312*a*. The hexagonal cross-section 312*a* of the lower region 312 is sized and shaped to snugly surround the outside polygonal perimeter of the end portion 156, or the end portion 256, 257, of either drill members 146, 246. A bottom shoulder 320 defines a bottom opening 322 and supports an end face 330 of either member 146, 246 in order to urge the drill member 146 or 246 axially during drilling.

The chuck 300 includes keys 336, 338 insertable into key ways (not shown) of the drilling head 34 to lock the chuck 300 for rotation to the drilling head 34 for motorized turning during drilling operation.

Figure 7:
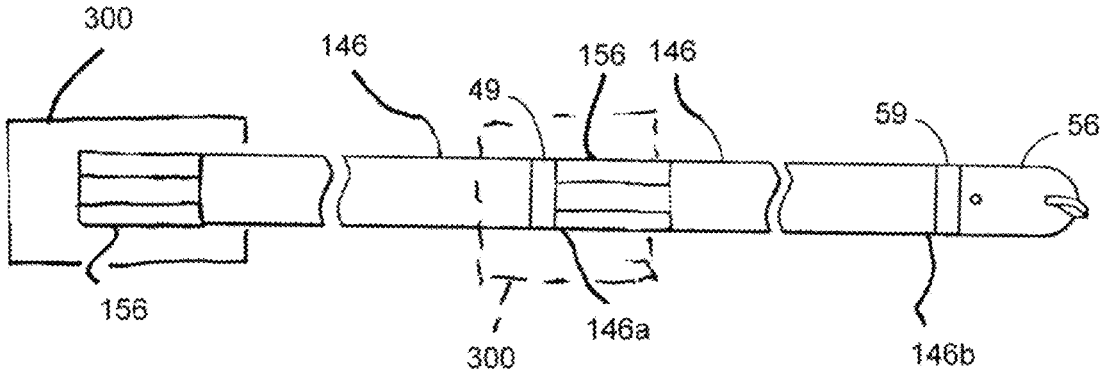
FIG. 7 is an enlarged plan view of the assembled, extended drill components of the drill system of FIGS. 4A-5B.

As illustrated in FIG. 7, a drill member 146 can be used to initially engage into the chuck 300 (shown schematically in phantom) of the drilling head at a base end 146*a* and receives a drill bit 56 and coupling 59 on the distal end 146*b*. As the drilled hole extends into the rock, an additional drill member 146' can be coupled between the base end 146*a* of the drill member 146 and the chuck 300 of the drilling head 34. The member 146' can be configured as a preconfigured piece such as a drill member 146 or can be a cut off section from a drill member 246, sized to suit. Multiple added drill members 146' can be added via couplings 49 as the drill assembly extends deeper into the rock. The drill member 246 includes end portions 256, 257 that are each configured to engage into the chuck of the drilling head. Thus, a drill member 246 can be cut to provide two lengths of drill member, equal lengths or not equal lengths that can be used to sequentially couple to the chuck of the drilling head. In effect, a first cut-off portion of a drill ember 246 can be drilled into the rock and then the second cut-off portion of the drill member 246 can be coupled to the chuck and to the training end of the first cut-off portion to continue drilling.

The coupling elements 49, 59 and the drill 56 are configured and coupled to the drill members 146, 146' using the inside polygonal perimeters of the drill members as described in the embodiment of FIGS. 2A and 2B.

The drill members 146, 246 can be cut to any length and the resultant cut open end can accommodate components without the need for machining a specialized coupling element or configuration. Additionally, the round outside perimeter of the tubes 148, 248 allows the drill member to be more quietly rotated within the drilled hole 47.

The inventive method is further characterized in that suction can be applied to the chuck 300 through the opening 322 of the chuck 300 to collect debris produced by the action of the drill bit 56, through the interior polygonal through opening of the drill members and couplings.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A drilling system for drilling vertical holes in a mine roof, comprising:

a chuck configured to be driven in rotation by a motorized drill driving device, said chuck having a first polygonal inside perimeter;

a drill member having an elongated hollow body having open ends, having a cross section defining a circular outside perimeter over most of its length and a constant, second polygonal inside perimeter along the entire length of said drill member, said drill member having at least one end region having a first polygonal outside perimeter sized to fit into said first polygonal inside perimeter to rotationally engage the drill member with the chuck; and a drill bit rotationally fixed to a base shank, extending rearward thereof, said base shank having a cross section with a second polygonal outside perimeter sized and configured to fit snugly inside said second polygonal inside perimeter;

wherein when viewed in a longitudinally axial direction, the first polygonal outside perimeter of the at least one end region is sized and shaped for the at least one end region to be radially circumscribed within the circular outside perimeter of the elongated hollow body.

2. The system according to claim 1, wherein said at least one end region has a length less than one foot.

3. The system according to claim 2, wherein said at least one end region has a length of about 6 inches.

4. The system according to claim 1, wherein the drill member has a length selected from the group consisting of 24 inches, 36 inches and 48 inches.

5. The drill member according to claim 1, wherein said drill member is between 2 feet and 12 feet long.

6. The drill member according to claim 1, wherein said first polygonal inside perimeter has a hexagonal shape.

7. The system according to claim 1, wherein the drill bit comprises a drill bit body and a drill bit seat that is separate from the drill bit body and includes the base shank.

8. The system according to claim 7, wherein the drill bit seat includes a drill bit shank extending opposite the base shank, and the drill bit body includes a socket for receiving the drill bit shank to be engaged in a rotationally fixed manner.

9. A drill member for use in a drilling system for installing roof bolts in a mine, comprising:

an elongated tube of at least 2 feet in length having a central through bore and opposite open ends, said tube having a constant transverse cross section along most of the length thereof that defines a smooth circular outside perimeter and a polygonal inside perimeter, and at least one end region having a polygonal outside perimeter and said polygonal inside perimeter;

wherein when viewed in a longitudinally axial direction, the polygonal outside perimeter of the at least one end region is sized and shaped for the at least one end region to be radially circumscribed within the circular outside perimeter of the elongated tube.

10. The drill member according to claim 9, wherein said polygonal inside perimeter allows for coupling of the tube to a drill bit at one end.

11. The drill member according to claim 9, wherein said tube is between 2 feet and 12 feet long.

12. The drill member according to claim 9, wherein said polygonal inside perimeter has a hexagonal shape.

13. The drill member according to claim 9, wherein said tube is about 12 feet long.

14. The drill member according to claim 9, wherein when viewed in an axial direction, the polygonal outside perimeter has a maximum transverse dimension equal to a diameter of the circular outside perimeter.

15. A method of drilling bores for installing bolts in a mine roof, comprising the steps of:

providing a length of a hollow drill member of at least 2 feet in length, said drill member having a round outside perimeter that is constant throughout substantially the entire length of said hollow drill member, and a polygonal inside perimeter that is constant throughout the entire length of said hollow drill member, and an end portion having a first polygonal outside perimeter wherein when viewed in a longitudinally axial direction, the first polygonal outside perimeter of the end portion is sized and shaped for the end portion to be radially circumscribed within the circular outside perimeter of the elongated tube;

providing a drill bit having a hollow bit fixture, said bit fixture having a second polygonal outside perimeter sized and shaped to fit snugly within an open end of said drill member to be coupled for rotation therewith;

providing a source of rotary power having a second polygonal inside perimeter sized and shaped to snugly receive said first outside polygonal perimeter;

fitting said end portion of said drill member into said source of rotary power;

fitting said bit fixture into an opposite end of said drill member; and rotating said drill member and urging said drill member upwardly.

16. The method according to claim 15, comprising the further step of applying suction to said hollow drill member to collect debris produced by said drill bit.

17. The method according to claim 15 comprising the further step of, when said drill bit progresses a predetermined distance, removing said hollow drill member from said source of rotary power and replacing said hollow drill member with a longer drill member of identical cross section as said hollow drill member, onto said source of rotary power, and resuming drilling.

18. The method according to claim 15 comprising the further step of, when said drill bit progresses a predetermined distance, removing said hollow drill member from said source of rotary power and, using a coupling, connecting a further drill member to the hollow drill member, said further drill member having an identical cross section as said hollow drill member, and connecting the further drill member to the source of rotary power, and resuming drilling.

19. The method according to claim 15 wherein said step of providing a length of a hollow drill member is further defined by providing a piece of hollow drill member stock, said drill member stock having a round outside perimeter and a polygonal inside perimeter that is constant throughout a length of said hollow drill member stock, said drill member stock being greater than 2 foot in length; and cutting said hollow drill member stock to reduce its length to said length of said hollow drill member.

20. A drill member for drilling vertical holes in a mine roof, comprising:

an elongated hollow body having open ends, and having a cross section defining a circular outside perimeter over most of a length of the hollow body and a constant, first polygonal inside perimeter along the entire length of said hollow body;

wherein at least one end region having a first polygonal outside perimeter sized to fit into a second polygonal inside perimeter of a drill chuck to rotationally engage the drill member with the drill chuck;

wherein when viewed in a longitudinally axial direction, the first polygonal outside perimeter of the at least one end region is sized and shaped for the at least one end region to be radially circumscribed within the circular outside perimeter of the elongated hollow body; and wherein the first polygonal inside perimeter of the drill member is sized and shaped to snugly receive a polygonal base shank of a drill piece.

21. The drill member according to claim 20, wherein said drill piece is another drill member, a drill bit, a drill bit seat, or a coupler.

22. The drill member according to claim 20, wherein when viewed in an axial direction, the first polygonal outside perimeter has a maximum transverse dimension equal to a diameter of the circular outside perimeter.

* * * * *